US009772125B2

(12) United States Patent
Morie et al.

(10) Patent No.: US 9,772,125 B2
(45) Date of Patent: Sep. 26, 2017

(54) CRYOGENIC REFRIGERATOR WITH SCOTCH YOKE DRIVING UNIT

(71) Applicant: Sumitomo Heavy Industries, Ltd., Tokyo (JP)

(72) Inventors: Takaaki Morie, Kanagawa (JP); Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 667 days.

(21) Appl. No.: 13/960,314

(22) Filed: Aug. 6, 2013

(65) Prior Publication Data

US 2014/0041397 A1 Feb. 13, 2014

(30) Foreign Application Priority Data

Aug. 7, 2012 (JP) ..... 2012-175169

(51) Int. Cl.
*F25B 9/00* (2006.01)
*F16H 21/18* (2006.01)
(Continued)

(52) U.S. Cl.
CPC ..... *F25B 9/14* (2013.01); *F01B 9/023* (2013.01); *F25B 2309/001* (2013.01);
(Continued)

(58) Field of Classification Search
CPC ..... F25B 2309/001; F25B 2309/1428; F25B 2400/073; F25B 2309/14181; F25B 2309/006; F01B 9/023
(Continued)

(56) References Cited

U.S. PATENT DOCUMENTS 4,294,077 A * 10/1981 Sarcia ..... F25B 9/14 137/625.37
4,333,755 A * 6/1982 Sarcia ..... F25B 9/14 137/625.37
(Continued)

FOREIGN PATENT DOCUMENTS

JP 04-055661 A 2/1992
JP 10122682 A * 5/1998

OTHER PUBLICATIONS

Translation of Japanese Patent Document No. JP 10122682 A entitled JP 10122682 A—Translation.*
"Spool valve mechanism used in a 20 K Gifford-McMahon cycle cryorefrigerator and its effect on the P-V diagram", M. Thirumaleshwar, R.C. Sharma, S.V. Subramanyam, 1987.*

*Primary Examiner* — Len Tran
*Assistant Examiner* — Paul Alvare
(74) *Attorney, Agent, or Firm* — Michael Best & Friedrich LLP

(57) ABSTRACT

A cryogenic refrigerator includes a displacer that is reciprocably mounted within a cylinder; a spool valve that is connected to the compressor and performs switching between an intake mode where a high-pressure refrigerant gas is supplied from the compressor to the cylinder and an exhaust mode where a low-pressure refrigerant gas within the cylinder is made to flow back to the compressor; and a drive unit that drives the spool valve. The spool valve has a valve body, and a drive rod that moves relative to the valve body and is integrated with the spool. The drive unit performs driving so that the magnitude of a speed when the drive rod moves from a top dead center to a bottom dead center is different from the magnitude of a speed when the drive rod moves from the bottom dead center to the top dead center, at the same displacement position.

5 Claims, 10 Drawing Sheets

(51) Int. Cl.

| | |
|---|---|
| ***F01B 19/00*** | (2006.01) |
| ***F16J 3/00*** | (2006.01) |
| ***F01B 9/00*** | (2006.01) |
| ***F16K 11/07*** | (2006.01) |
| ***F16K 11/074*** | (2006.01) |
| ***G05D 23/00*** | (2006.01) |
| ***F16K 1/00*** | (2006.01) |
| ***F16K 15/00*** | (2006.01) |
| ***F25B 9/14*** | (2006.01) |
| *F01B 9/02* | (2006.01) |

(52) U.S. Cl.
CPC . *F25B 2309/006* (2013.01); *F25B 2309/1428* (2013.01); *F25B 2309/14181* (2013.01); *F25B 2400/073* (2013.01)

(58) Field of Classification Search
USPC ..... 62/6; 74/50; 92/40, 136; 137/625.68, 137/625.2; 165/298; 251/318
See application file for complete search history.

(56) References Cited

U.S. PATENT DOCUMENTS 4,362,024 A * 12/1982 Winkler ..... F25B 9/14 137/625.37
4,438,631 A * 3/1984 Sarcia ..... F25B 9/14 60/520
4,543,793 A * 10/1985 Chellis ..... F25B 9/14 60/520
4,584,972 A * 4/1986 Jayne ..... F01B 9/023 123/197.4
5,156,121 A * 10/1992 Routery ..... F01B 9/02 123/197.3
5,398,512 A * 3/1995 Inaguchi ..... F25B 9/14 62/6
7,328,682 B2 * 2/2008 Fisher ..... F01B 9/023 123/197.4
2011/0126554 A1 * 6/2011 Morris ..... F04B 37/08 62/6

* cited by examiner

EXHAUST CLOSED(θ2)

TOP DEAD POINT(θ0)

BOTTOM DEAD POINT( θ 4)

INTAKE OPENED( θ 3)

INTAKE CLOSED(θ5)

EXHAUST OPENED(θ6)

TOP DEAD POINT(θ7=θ0)

CRYOGENIC REFRIGERATOR WITH SCOTCH YOKE DRIVING UNIT

INCORPORATION BY REFERENCE

Priority is claimed on Japanese Patent Application No. 2012-175169, filed Aug. 7, 2012, the entire content of which is incorporated herein by reference.

BACKGROUND

Technical Field

The present invention relates to a cryogenic refrigerator that has a displacer.

Description of the Related Art

In the related art, a Gifford McMahon refrigerator (hereinafter referred to as GM refrigerator) is known as a cryogenic refrigerator including a displacer. The GM refrigerator is configured so that the displacer reciprocally moves within a cylinder by a drive unit.

Additionally, an expansion space is formed between the cylinder and the displacer. A pressurized refrigerant gas supplied from a compressor expands in the expansion space and is returned to the compressor to thereby generate cryogenic refrigeration.

Additionally, a GM refrigerator having a configuration in which a spool valve performs switching between the supply and return of a refrigerant gas is also suggested in the related art.

SUMMARY

According to an embodiment of the present invention, there is provided a cryogenic refrigerator including a displacer that is reciprocably mounted within a cylinder; a spool valve that is connected to the compressor and performs switching between an intake mode where a high-pressure refrigerant gas is supplied from the compressor to the cylinder and an exhaust mode where a low-pressure refrigerant gas within the cylinder is made to flow back to the compressor; and a drive unit that drives the spool valve. The spool valve has a valve body, and a drive rod that moves relative to the valve body and is integrated with the spool, and the drive unit performs driving so that the magnitude of a speed when the drive rod moves from a top dead center to a bottom dead center is different from the magnitude of a speed when the drive rod moves from the bottom dead center to the top dead center, at the same displacement position.

DETAILED DESCRIPTION

In the cryogenic refrigerator, the timing of switching between the supply and return of a refrigerant gas is one of parameters that have the greatest influence on cooling efficiency, and the cooling efficiency may be greatly improved by optimizing this timing.

It is desirable to provide a cryogenic refrigerator that improves cooling efficiency by setting suitable timings of opening and closing of a valve.

According to the disclosed cryogenic refrigerator, the timings of supply and return of a high-pressure gas by the spool valve can be easily set by making the magnitude of the speed when the drive rod moves from the top dead center of the displacer to the bottom dead center and the magnitude of the speed when the drive rod moves from the bottom dead center to the top dead center different from each other at the same displacement position.

Thereby, for example, the exhaust period of the refrigerant gas after the top dead center may be extended. In this way, the heat-exchange time between the refrigerant gas in which cooling is generated, and a cooling stage connected to the cylinder and a regenerative material provided in the displacer can be made longer than that in the related art. Accordingly, the heat exchange between the refrigerant gas and, the cooling stage and the regenerative material, can be sufficiently performed.

Additionally for example, the intake period of the refrigerant gas before the bottom dead center may be delayed. In this way, a refrigerant gas expanded in the expansion stroke can be thoroughly returned, and heat exchange between the refrigerant gas and, the cooling stage or the regenerative material, can be sufficiently performed.

By using the spool valve with a comparatively simple structure in this way, the cooling efficiency of the cryogenic refrigerator can be improved and the structure can be simplified.

Next, embodiments of the invention will be described together with drawings.

Figure 1:
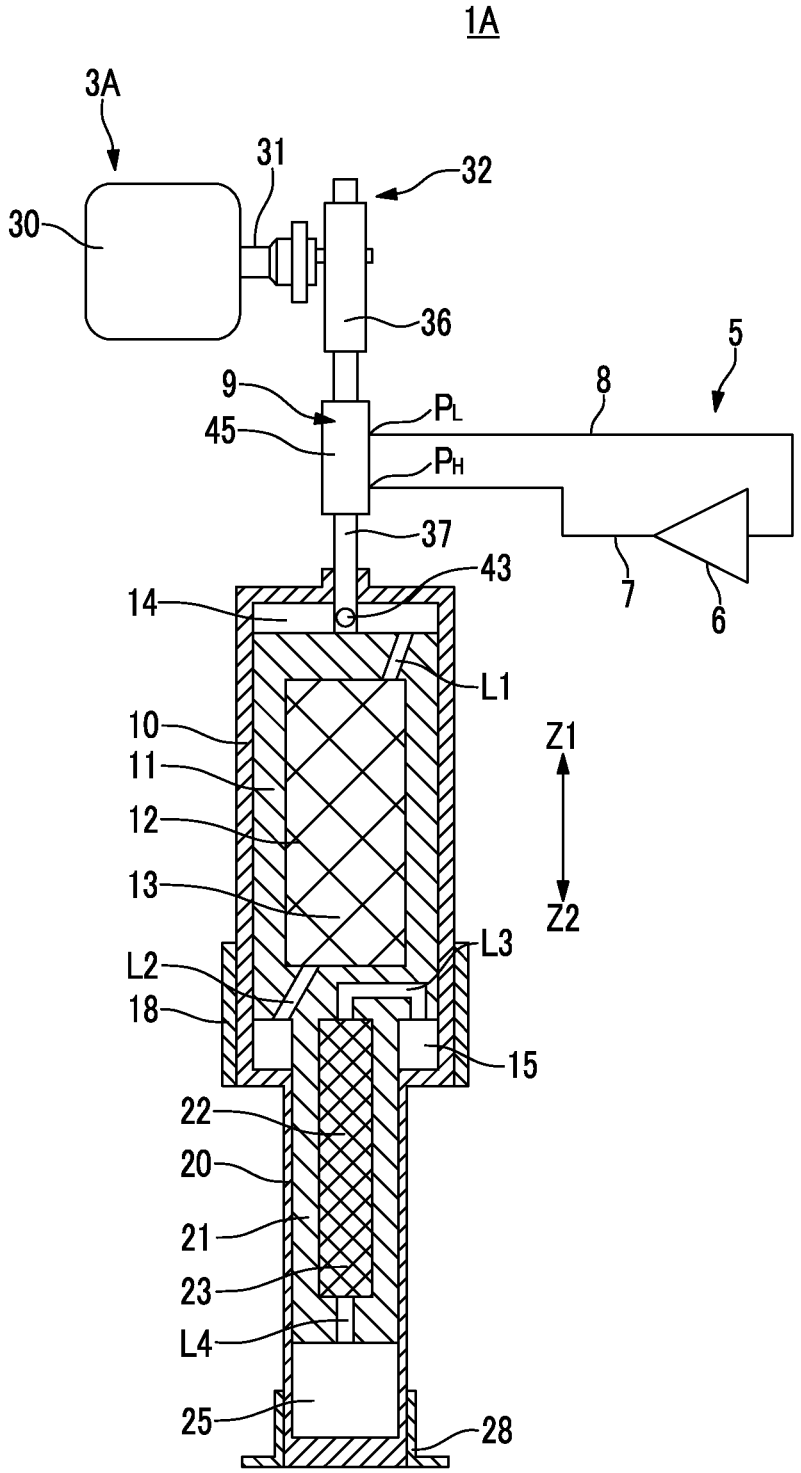
FIG. 1 is a partial cross-sectional view of a GM refrigerator according to an embodiment of the invention.

FIG. 1 shows a cryogenic refrigerator that is an embodiment of the invention. In the following description, description will be made taking as an example with a cryogenic refrigerator (hereinafter referred to as GM refrigerator) using a Gifford McMahon cycle. However, application of the invention is not limited to the GM refrigerator and application can also be made to various cryogenic refrigerators (for example, a Solvay refrigerator, a Stirling refrigerator, and the like) that use a displacer.

The GM refrigerator 1A related to the present embodiment is a two-stage type refrigerator, and has a first-stage cylinder 10 and a second-stage cylinder 20. The first- and second-stage cylinders 10 and 20 are formed of stainless steel or the like having a low heat conductivity. Additionally, a high-temperature end of the second-stage cylinder 20 is configured so as to be coupled to a low-temperature end of the first-stage cylinder 10.

The second-stage cylinder 20 has a diameter smaller than the first-stage cylinder 10. A first-stage displacer 11 is reciprocably mounted within the first-stage cylinder 10, and a second-stage displacer 21 is reciprocably mounted within the second-stage cylinder 20. The first-stage displacer 11 and the second-stage displacer 21 are coupled to each other, and are driven to reciprocate between a top dead center and a bottom dead center within the cylinders 10 and 20 (driven in the directions of arrows Z1 and the Z2 in the drawing) by a drive unit 3A.

In addition, although FIG. 1 shows that the first-stage displacer 11 and the second-stage displacer 21 are integrated with each other for convenience of illustration, practically, the displacers are configured so as to be coupled together via a link mechanism.

Additionally, regenerators 12 and 22 are provided inside the first-stage displacer 11 and the second-stage displacer 21, respectively. The insides of the regenerators 12 and 22 are filled with regenerative materials 13 and 23, respectively.

Additionally, a room-temperature chamber 14 is formed at a high-temperature end within the first-stage cylinder 10, and a first-stage expansion chamber 15 is formed at the low-temperature end. Moreover, a second-stage expansion chamber 25 is formed on a low-temperature side of the second-stage cylinder 20.

The first-stage displacer 11 and the second-stage displacer 21 are provided with a plurality of gas flow channels L1 to L4 into which a refrigerant gas (helium gas) flows. The gas flow channel L1 connects the room-temperature chamber 14 and the regenerator 12, and the gas flow channel L2 connects the regenerator 12 and the first-stage expansion chamber 15. Additionally, the gas flow channel L3 connects the first-stage expansion chamber 15 and the regenerator 22, and the gas flow channel L4 connects the regenerator 23 and the second-stage expansion chamber 25.

The room-temperature chamber 14 on the side of the high-temperature end of the first-stage cylinder 10 is connected to a gas supply system 5. The gas supply system 5 is configured so as to include a compressor 6, intake piping 7, exhaust piping 8, a spool valve 9, an upper circulation hole 42, a lower circulation hole 43, a communication channel 44, and the like (refer to FIGS. 3A and 3B regarding the respective circulation holes and channel 42 to 44).

One end of the intake piping 7 is connected to a suction side of the compressor 6, and the other end thereof is connected to an intake port $P_H$ of the spool valve 9. Additionally, one end of the exhaust piping 8 is connected to a discharge side of the compressor 6, and the other end thereof is connected to an exhaust port $P_L$ of the spool valve 9.

Figure 3B:
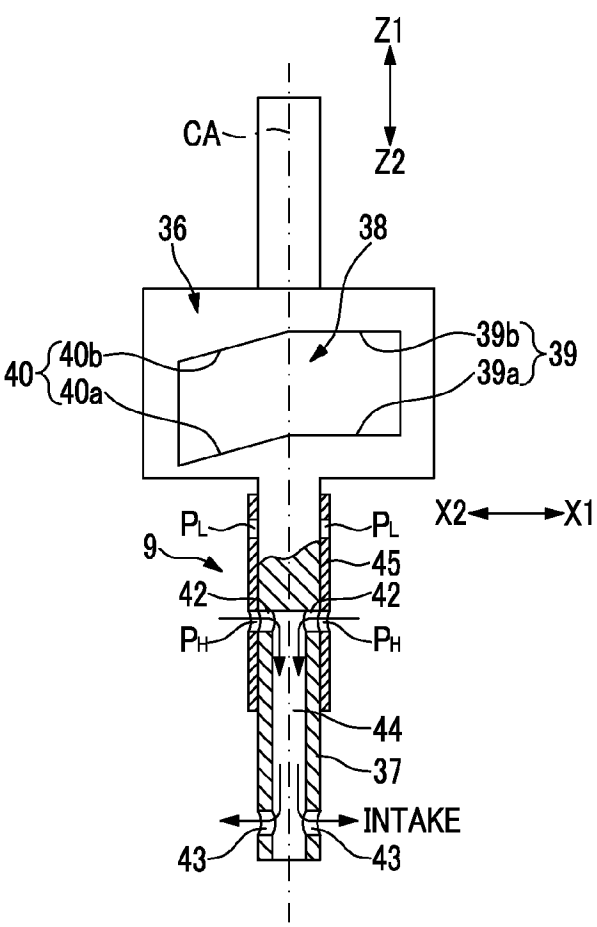
FIGS. 3A and 3B are enlarged partial cross-sectional views showing a spool valve provided in the GM refrigerator according to the embodiment of the invention.
Figure 3A:
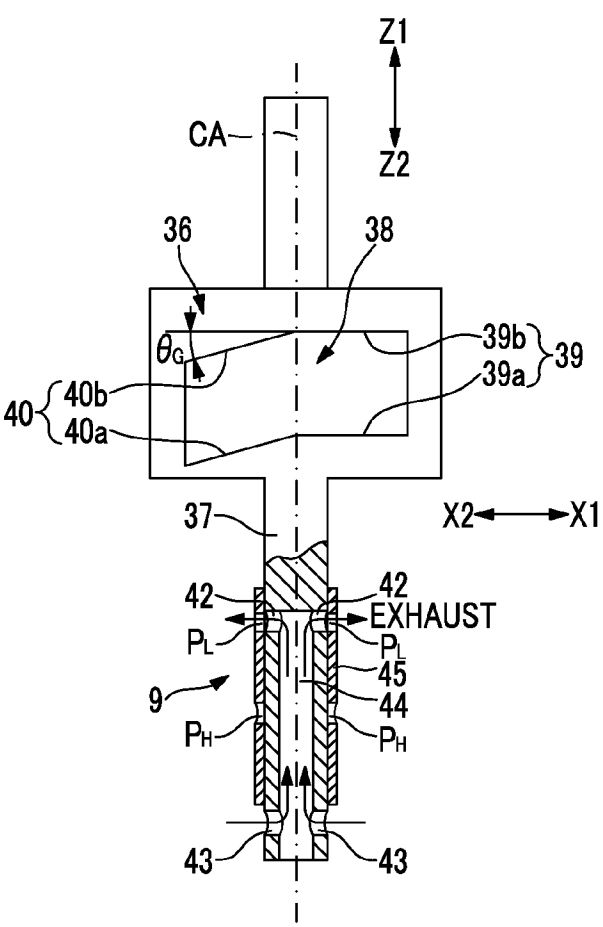

The spool valve 9, as shown in FIGS. 3A and 3B, has a tubular spool body 45 (equivalent to a valve body described in the claims) that can function as a sleeve, and a spool configured so as to be movable relative to the spool body 45.

The spool body 45 has the exhaust port $P_L$ and the intake port $P_H$. The exhaust port $P_L$ is provided on the upper side of the spool body 45 (Z1-direction side), and the intake port $P_H$ is provided on the lower side of the spool body 45 (Z2-direction side), and hence, the exhaust port $P_L$ and the intake port $P_H$ are arranged so as to be spaced apart from each other.

The intake piping 7 is connected to the intake port $P_H$, and the exhaust piping 8 is connected to the exhaust port $P_L$. Hence, a high-pressure refrigerant gas is supplied from the compressor 6 to the intake port $P_H$, and the refrigerant gas that has expanded as low-pressure gas, as will be described below, flows back from the exhaust port $P_L$ to the compressor 6.

The spool is configured integrally with a drive rod 37 of the scotch yoke mechanism 32, to be described below. Hence, in the present specification, the drive rod 37 with which the spool is integrated is referred to as drive rod 37 with a spool. In addition, the integral configuration in the present application means a configuration in which the spool can move integrally with the drive rod, and a configuration in which the drive rod and the spool are separable from each other may be adopted.

The first-stage displacer 11 is coupled to a lower end portion of the drive rod 37 with a spool. The drive rod 37 with a spool is formed with the upper circulation hole 42, the lower circulation hole 43, and the communication channel 44. The arrangement positions of the respective holes 42, 43, and channel 44 are set to positions below the arrangement position (position on the side of the Z2 direction) of the scotch yoke 36 of the drive rod 37 with a spool.

The upper circulation hole 42 and the lower circulation hole 43 are formed so as to pass through the drive rod 37 with a spool in a direction orthogonal to the direction of a central axis. Additionally, the upper circulation hole 42 and the lower circulation hole 43 are arranged so as to be spaced apart from each other in the direction (Z1 or Z2 direction) of the central axis of the drive rod 37 with a spool. Moreover, as shown in FIG. 1, the lower circulation hole 43 opens to the room-temperature chamber 14.

On the other hand, the communication channel 44 is formed along the central axis inside the drive rod 37 with a spool. An upper end portion of the communication hole 44 is connected to the upper circulation hole 42, and a lower end portion thereof is connected to the lower circulation hole 43. Since the upper circulation hole 42 and the lower circulation hole 43 are connected to each other via the communication channel 44 in this way, the upper circulation hole 42 is configured so as to communicate with the room-temperature chamber 14 via the communication channel 44 and the lower circulation hole 43. Hence, the refrigerant gas is enabled to move between the upper circulation hole 42 and the lower circulation hole 43.

Next, the operation of the spool valve 9 will be described with reference to FIGS. 3A and 3B.

The spool body 45 is fixed to a motor housing (the illustration thereof is omitted) that stores a motor 30. In contrast, the drive rod 37 with a spool that constitutes the spool valve 9 reciprocally moves in the Z1 and Z2 directions by the scotch yoke mechanism 32 that constitutes the drive unit 3A. Accordingly, the drive rod 37 with a spool reciprocally moves in the Z1 and the Z2 directions with respect to the fixed spool body 45.

FIG. 3A shows a state where the drive rod 37 with a spool has moved to a movement limit position (upward movement limit position) in the Z1 direction. The displacers 11 and 21 are located at the top dead center in a state where the drive rod 37 with a spool has moved to the movement limit position in the Z1 direction. Hence, in the present specification, description will be described using a position when the drive rod 37 with a spool has moved to its movement limit in the Z1 direction as the top dead center, similar to the displacers 11 and 21.

The exhaust port $P_L$ of the spool body 45 is configured so as to face and communicate with the upper circulation hole 42 of the drive rod 37 with a spool, in a state where the drive rod 37 with a spool has moved to the top dead center. In contrast, the intake port $P_H$ of the spool body 45 is configured so as to be closed while facing the outer peripheral wall of the drive rod 37 with a spool.

Accordingly, the room-temperature chamber 14 is configured so as to be connected to the discharge side of the compressor 6 via the lower circulation hole 43, the communication channel 44, the upper circulation hole 42, the exhaust port $P_L$, and the exhaust piping 8 in a state where the first- and second-stage displacers 11 and 21 are located at the top dead center.

In contrast, FIG. 3B shows a state where the drive rod 37 with a spool has moved to a movement limit position (downward movement limit position) in the Z2 direction. The displacers 11 and 21 are located at the bottom dead center in a state where the drive rod 37 with a spool has moved to the movement limit position in the Z2 direction. Hence, in the present specification, description will be made using a position when the drive rod 37 with a spool has moved to its movement limit in the Z2 direction as the bottom dead center, similar to the displacers 11 and 21.

The intake port $P_H$ of the spool body 45 is configured so as to face and communicate with the upper circulation hole 42 of the drive rod 37 with a spool, in a state where the drive rod 37 with a spool has moved to the bottom dead center. In contrast, the exhaust port $P_L$ of the spool body 45 is configured so as to be closed while facing the outer peripheral wall of the drive rod 37 with a spool.

Accordingly, the room-temperature chamber 14 is configured so as to be connected to the suction side of the compressor 6 via the lower circulation hole 43, the communication channel 44, the upper circulation hole 42, the intake port $P_H$, and the intake piping 7 in a state where the first- and second-stage displacers 11 and 21 are located at the bottom dead center.

Next, the drive unit 3A will be described.

Figure 2:
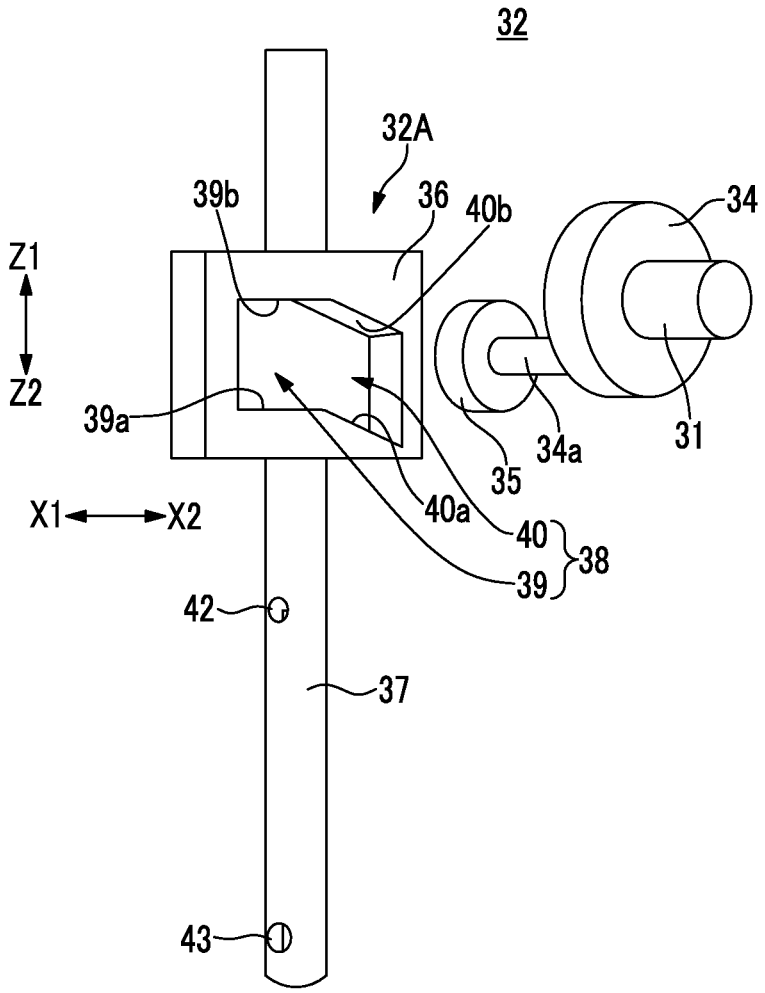
FIG. 2 is an enlarged perspective view showing a scotch yoke mechanism provided in the GM refrigerator according to the embodiment of the invention.

The drive unit 3A reciprocally moves the first- and second-stage displacers 11 and 21 within the first- and second-stage cylinders 10 and 20. The drive unit 3A has the motor 30 and the scotch yoke mechanism 32. FIG. 2 shows the scotch yoke mechanism 32 in an enlarged manner. The scotch yoke mechanism 32 is generally configured so as to have a crank 34, a scotch yoke 36, and the drive rod 37 with a spool.

The crank 34 is fixed to a rotating shaft (hereinafter referred to as a motor shaft 31) of the motor 30. The crank 34 has provided a pin 34*a* at a position that is eccentric from the attachment position of the motor shaft 31. Additionally, a roller bearing 35 (equivalent to a drive shaft described in the claims) is rotatably attached to a tip portion of the pin 34*a*.

The scotch yoke 36 is formed in a frame shape as a sliding groove 38 is formed in the scotch yoke. The roller bearing 35 provided in the crank 34 movably engages the sliding groove 38 formed in the scotch yoke 36. The roller bearing 35 is configured so as to be rollable in the directions of arrows X1 and X2 in the drawing within the sliding groove 38.

Additionally, the pin 34*a* that bears the roller bearing 35 is eccentric from the motor shaft 31 as mentioned above. Accordingly, if the motor shaft 31 rotates, the pin 34*a* rotates so as to draw a circular arc, and thereby, the scotch yoke 36 performs reciprocal movement in the directions of arrows Z1 and Z2 in the drawing. In this case, the roller bearing 35 reciprocally moves within the sliding groove 38 in the directions of arrows X1 and X2 in the drawing. In addition, the specific shape and configuration of the scotch yoke 36 and the sliding groove 38 will be described below in detail for convenience of description.

The scotch yoke 36 is provided with the drive rod 37 with a spool that extends in upward and downward directions. Among this, the lower drive rod 37 with a spool, as shown in FIG. 1, is coupled to the first-stage displacer 11. Hence, if the scotch yoke 36 reciprocally moves in the Z1 and Z2 directions by the scotch yoke mechanism 32 as described above, the drive rod 37 with a spool also moves in the upward and downward directions, and thereby, the first- and second-stage displacers 11 and 21 reciprocally move within the first- and second-stage cylinders 10 and 20.

Moreover, in the drive rod 37 with a spool below the scotch yoke 36, the upper circulation hole 42, the lower circulation hole 43, and the communication channel 44 that constitute the spool valve 9 are formed as mentioned above, and the spool body 45 is arranged.

Here, the configuration and function of the scotch yoke 36 will be described mainly with reference to FIGS. 2 and 3 while paying attention to the scotch yoke that constitutes the scotch yoke mechanism 32.

FIGS. 3A and 3B are front views of the scotch yoke 36. As mentioned above, the scotch yoke 36 is formed with the sliding groove 38 that extends in the X1 and X2 directions. A sliding groove of a scotch yoke of the related art is generally formed in a horizontally long rectangular shape or a long elliptical shape.

In contrast, in the present embodiment, the sliding groove 38 is configured so as to be asymmetrical to the right and left (in the directions of arrows X1 and X2) with respect to a central axis CA of the drive rod 37 with a spool. Specifically, the sliding groove 38 is configured so as to have a horizontal groove 39 and an inclination groove 40, the horizontal groove 39 is formed on the right side (X1-direction side) of the central axis CA, and the inclination groove 40 is formed on the left side (X2-direction side) of the central axis CA.

The horizontal groove 39 has a horizontal groove lower portion 39*a* at a lower portion thereof, and has a horizontal groove upper portion 39*b* at an upper portion thereof. The horizontal groove lower portion 39*a* and the horizontal groove upper portion 39*b* are configured so as to face each other in parallel. Similarly, the inclination groove 40 has an inclination groove lower portion 40*a* at a lower portion thereof, and has an inclination groove upper portion 40*b* at an upper portion thereof. The inclination groove lower portion 40*a* and the inclination groove upper portion 40*b* are also configured so as to face each other in parallel.

The horizontal groove 39 is formed so as to extend in the horizontal direction (a direction orthogonal to the central axis CA). The shape of the horizontal groove 39 is configured so as to be equivalent to that of the groove provided in the scotch yoke of the related art.

In contrast, the inclination groove 40 is formed so as to incline downward (Z2 direction) by an angle $\theta_G$ with respect to the horizontal direction (hereinafter referred to as inclination angle $\theta_G$). Hence, the inclination groove 40 is configured so as to extend obliquely downward from a position contacting the horizontal groove 39.

In addition, by performing chamfering at a position where the horizontal groove 39 and the inclination groove 40 contact each other, the roller bearing 35 may be configured so as to move smoothly when moving between the horizontal groove 39 and the inclination groove 40.

Next, the operation of the GM refrigerator 1 configured as above will be described.

If the first- and second-stage displacers 11 and 21 are displaced to a predetermined position (position corresponding to θ3 shown in FIG. 4) before reaching the bottom dead center, as will be described below in detail, the refrigerant gas supply system 5 performs switching to a mode (hereinafter referred to as intake mode) in which the suction side of the compressor 6 and the room-temperature chamber 14 (cylinders 10 and 20) are caused to communicate with each other.

In the intake mode, the high-pressure refrigerant gas generated by the compressor 6 flows into the regenerator 12 formed in the first-stage displacer 11 via the intake piping 7, the spool valve 9, the room-temperature chamber 14, and the gas flow channel L1. The refrigerant gas that has flowed into the regenerator 12 advances while being cooled by the regenerative material 13 within the regenerator 12, and subsequently flows into the first-stage expansion chamber 15 via the gas flow channel L2.

The refrigerant gas that has flowed into the first-stage expansion chamber 15 flows into the regenerator 22 formed in the second-stage displacer 21 via the gas flow channel L3. Then, the refrigerant gas that has flowed into the regenerator 22 advances while being further cooled by the regenerative material 23 within the regenerator 22, and subsequently flows into the second-stage expansion chamber 25 via the gas flow channel L4.

The first- and second-stage displacers 11 and 21 are driven by the drive unit 3A and move downward (move in the Z2 direction), and reach the bottom dead center BDC (position corresponding to θ4 shown in FIG. 4) where the volumes of the first- and second-stage expansion chambers 15 and 25 become the smallest.

Thereafter, the first- and second-stage displacers 11 and 21 start to move upward (in the direction of arrow Z1 in the drawing) by the drive unit 3A. Along with this, the high-pressure refrigerant gas supplied from the compressor 6 is taken (supplied) into the first-stage expansion chamber 15 and the second-stage expansion chamber 25 through the above path.

Then, when the first- and second-stage displacers 11 and 21 reach predetermined positions (positions corresponding to θ5 shown in FIG. 4), the spool valve 9 cuts off the connection between the compressor 6 and the room-temperature chamber 14, and terminates the intake mode. Thereby, the supply of the refrigerant gas from the gas supply system 5 to the room-temperature chamber 14 is stopped.

After the termination of the intake mode, the drive unit 3A further moves the first- and second-stage displacers 11 and 21 upward. Then, if the first- and second-stage displacers 11 and 21 reach predetermined positions (positions corresponding to θ6 shown in FIG. 4), the gas supply system 5 performs switching to a mode (hereinafter referred to as exhaust mode) where the discharge side of the compressor 6 and the room-temperature chamber 14 (cylinders 10 and 20) are connected to each other. Thereby, the refrigerant gas within the first- and second-stage expansion chamber 15 and 25 expands, and cooling is generated in each of the expansion chambers 15 and 25.

Even after the refrigerant gas supply system 5 performs switching to the exhaust mode, the first- and second-stage displacers 11 and 21 are driven by the drive unit 3A and move upward (move in the Z1 direction), and reach the top dead center TDC (position corresponding to θ0 and θ7 shown in FIG. 4) where the volumes of the first- and second-stage expansion chambers 15 and 25 become the largest.

Thereafter, the first- and second-stage displacers 11 and 21 start to move downward (in the direction of arrow Z2 in the drawing) by the drive unit 3A. Along with this, the refrigerant gas that has expanded in the second-stage expansion chamber 25 flows into the regenerator 22 through the gas flow channel L4, passes through while cooling the regenerative material 23 within the regenerator 22, and flows into the first-stage expansion chamber 15 via the gas flow channel L3.

The refrigerant gas that has flowed into the first-stage expansion chamber 15 flows into the regenerator 12 via the gas flow channel L2 together with the refrigerant gas that has expanded in the first-stage expansion chamber 15. The refrigerant gas that has flowed into the regenerator 12 advances while cooling the regenerative material 13, and is then returned to the discharge side of the compressor 6 via the gas flow channel L1, the room-temperature chamber 14, the spool valve 9, and the exhaust piping 8.

Then, when the first- and second-stage displacers 11 and 21 reach predetermined positions (positions corresponding to θ2 shown in FIG. 4), the refrigerant gas supply system 5 terminates the exhaust mode. Thereby, the exhaust of the refrigerant gas from the room-temperature chamber 14 to the gas supply system 5 is stopped.

By repeating the above cycle, a low temperature of about 20 to 50 K can be generated in the first-stage expansion chamber 15, and an ultra low temperature of 4 to 10 K or lower can be generated in the second-stage expansion chamber 25.

Next, the operation of the drive unit 3A and the refrigerant gas supply system 5 that are provided in the GM refrigerator 1A will be described mainly with reference to FIGS. 4 to 6.

Figure 4:
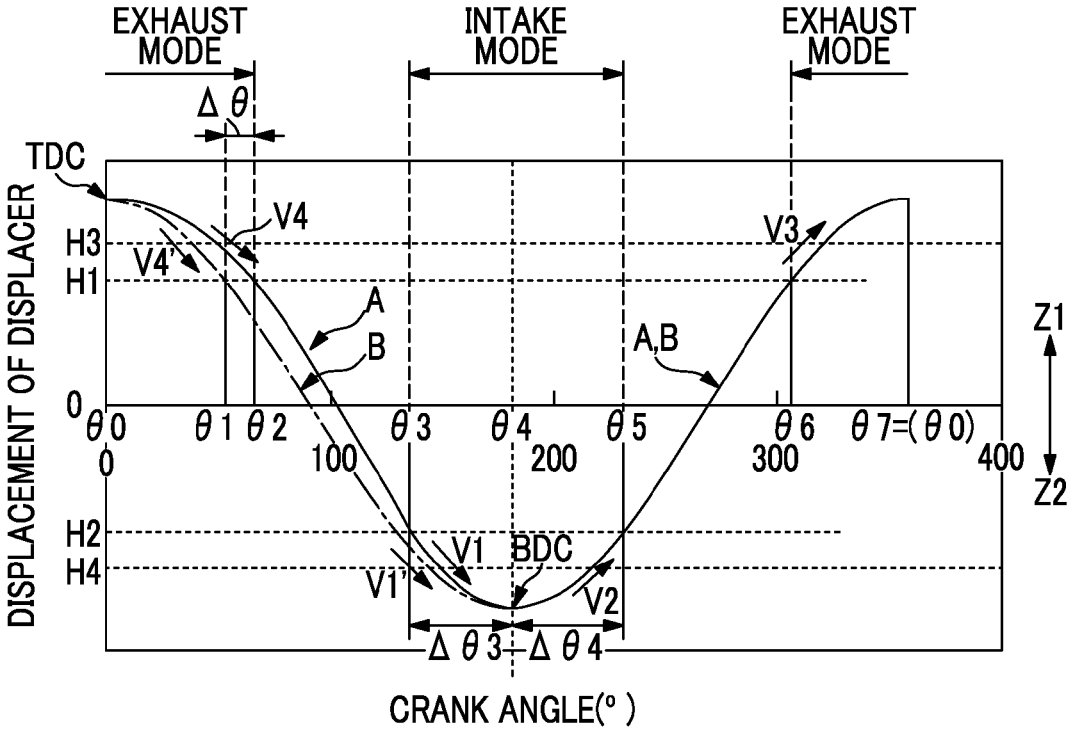
FIG. 4 is a view showing the displacement of a displacer of the GM refrigerator according to the embodiment of the invention.

FIG. 4 is a view showing displacement during one cycle of displacers 11 and 21 (this is equal to the displacement of the drive rod 37 with a spool). Additionally, FIGS. 5 and 6 are views showing the operation of the spool valve 9 and the scotch yoke mechanism 32 that are provided in the GM refrigerator 1A.

In addition, FIG. 4 shows the displacement of the displacers 11 and 21 as a distance from the center position when the center position of the top dead center (TDC) and the bottom dead center (BDC) is zero. Additionally the horizontal axis of FIG. 4 shows the rotation angle (the crank angle) of the crank 34.

Moreover, FIG. 4 shows the characteristics (characteristics of a GM refrigerator with a rectangular sliding groove) of a GM refrigerator of the related art for reference together with the characteristics of the GM refrigerator 1A related to the present embodiment. In FIG. 4, the displacement characteristics (displacement locus) of the displacers 11 and 21 of the GM refrigerator 1A related to the present embodiment are shown by arrow A, and the displacement characteristics (displacement locus) of the GM refrigerator related to the reference example is shown by arrow B.

The refrigerant gas supply system 5 related to the present embodiment controls the timing of switching of the intake mode and the exhaust mode using the spool valve 9. The timing of opening and closing of the spool valve 9 is performed by movement of the drive rod 37 with a spool that functions also as a spool driven by the scotch yoke mechanism 32.

Here, the intake mode means a mode where the high-pressure refrigerant gas within the cylinders 10 and 20 is taken in from the suction side of the compressor 6, and the exhaust mode means a mode where the low-pressure refrigerant gas that has expanded as low-pressure gas is exhausted from the cylinders 10 and 20 to the discharge side of the compressor 6.

Additionally, in the present embodiment, the exhaust mode is set while the displacers 11 and 21 are moving in a region that is separated by a distance H1 or more in the Z1 direction from the center position (the rotation angle is θ6 to θ2), and the intake mode is set while the displacers 11 and 21 are moving in a region that is separated by a distance H2 or more in the Z2 direction from the center position (the rotation angle is θ3 to θ5).

In the following description, the operation after the displacers 11 and 21 are located at the top dead center will be described. In addition, in FIG. 4, the crank angle when the displacers 11 and 21 are located at the top dead center is set to θ0 (=0°).

Figure 5B:
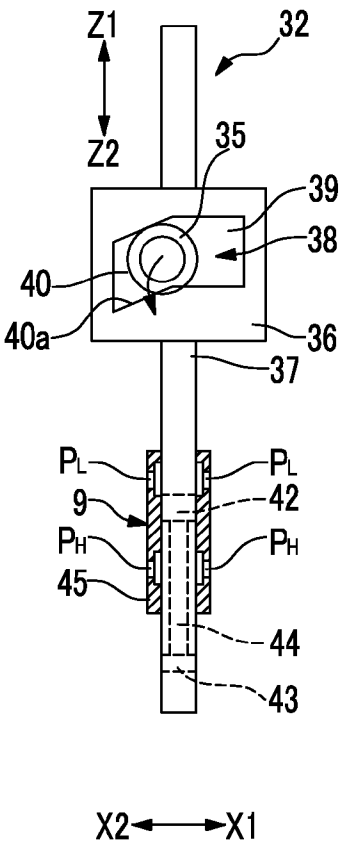
FIGS. 5A to 5D are views for describing the operation of the GM refrigerator according to the embodiment of the invention (Process 1).
Figure 5A:
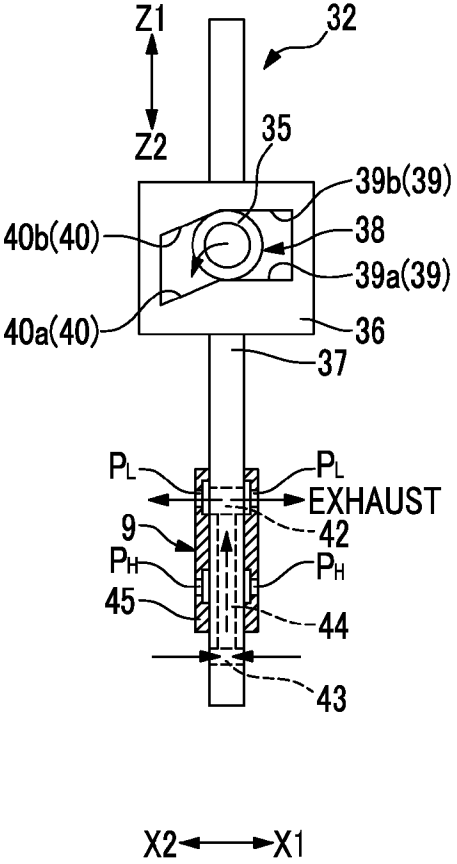

FIG. 5A shows the scotch yoke mechanism 32 when the displacers 11 and 21 are located at the top dead center. At this time, the roller bearing 35 is located at a middle position (boundary position where the horizontal groove 39 and the inclination groove 40 contact each other) within the sliding groove 38.

On the other hand, when the crank angle is θ0, the refrigerant gas supply system 5 is in the exhaust mode. In the exhaust mode, the spool valve 9 is brought into a state where the upper circulation hole 42 and the exhaust port $P_L$ communicate with each other and a state where the intake port $P_H$ is closed.

Hence, the room-temperature chamber 14 within the first-stage cylinder 10 is connected to the discharge side of the compressor 6 via the lower circulation hole 43, the communication hole 44, the upper circulation hole 42, the exhaust port $P_L$, and the exhaust piping 8. In addition, the exhaust mode is carried out while the crank angle is θ6 to θ2 (θ6 to θ7 and θ0 to θ2), and in the exhaust mode, a high-pressure refrigerant gas performs expansion in the respective expansion chambers 15 and 25 to generate cooling. Additionally, the refrigerant gas that has become low-pressure gas by expansion flows back to the discharge side of a compressor 6 via the spool valve 9 during the exhaust mode.

If the crank 34 rotates from the state shown in FIG. 5A, along with the operation, the roller bearing 35 moves in the X2 direction within the sliding groove 38, and advances within the inclination groove 40. As mentioned above, since the pin 34*a* to which the roller bearing 35 is attached is at a position that is eccentric from the center of the crank 34, the scotch yoke 36 moves in the direction of Z2 along with the movement of the roller bearing 35.

Additionally, the displacers 11 and 21 are connected to the scotch yoke 36 via the drive rod 37 with a spool. For this reason, if the drive rod 37 with a spool moves along with the movement of the scotch yoke 36, the displacer 11 and 21 moves in the Z2 direction.

As mentioned above, the drive rod 37 with a spool functions also as a spool of the spool valve 9, and is formed with the upper circulation hole 42, the lower circulation hole 43, and the communication channel 44. Hence, as the drive rod 37 with a spool moves in the Z2 direction, the upper circulation hole 42 that communicates with the exhaust port $P_L$ moves so as to separate gradually from the exhaust port $P_L$.

FIG. 5B shows a state where the crank 34 has rotated to 82 shown in FIG. 4 by the drive unit 3A, and hence, the displacers 11 and 21 have moved to a displacement amount H1. In this state, the upper circulation hole 42 and the exhaust port $P_L$ of the spool valve 9 are spaced apart from each other, and the discharge side of the compressor 6 and the room-temperature chamber 14 (cylinders 10 and 20) are brought into a cut-off state. In addition, even at this time, the state where the intake port $P_H$ is cut off is maintained.

If the crank 34 further rotates from the state shown in FIG. 5B, the roller bearing 35 moves in the X2 direction within the sliding groove 38 to an end portion of the sliding groove along with this operation, and then the movement direction thereof is changed to the X1 direction. Even in the movement of the roller bearing 35, the scotch yoke 36 continues moving in the Z2 direction.

Figure 5D:
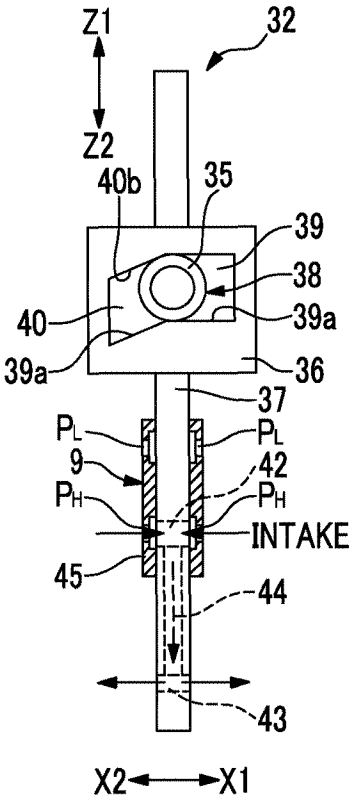
Figure 5C:
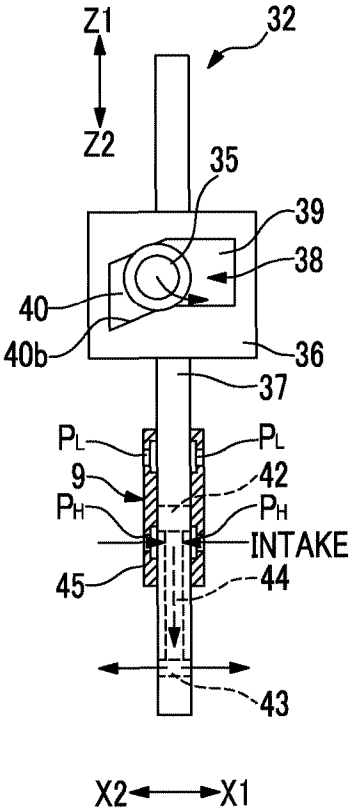

FIG. 5C shows a state where the crank 34 has rotated to θ3 shown in FIG. 4 by the drive unit 3A, and hence, the displacers 11 and 21 have moved to a displacement amount H2. In this state, the refrigerant gas supply system 5 performs switching to the intake mode. That is, along with the movement of the drive rod 37 with a spool, the upper circulation hole 42 and the intake port $P_H$ of the spool valve 9 start to communicate with each other, and are brought into a state where the intake side of the compressor 6 and the room-temperature chamber 14 (cylinders 10 and 20) are connected to each other. In addition, even at this time, the state where the exhaust port $P_L$ is cut off is maintained.

In this way, since the refrigerant gas supply system 5 are brought into a state where the intake side of the compressor 6 and the room-temperature chamber 14 are connected to each other, a high-pressure refrigerant gas is taken in (supplied) from the compressor 6 to the room-temperature chamber 14.

FIG. 5D shows a state where the crank 34 has rotated to θ4 shown in FIG. 4 by the drive unit 3A, and hence, the displacers 11 and 21 have moved to the bottom dead center. At this time, the roller bearing 35 is brought into a state where the roller bearing is returned to the middle position (boundary position where the horizontal groove 39 and the inclination groove 40 contact each other) within the sliding groove 38. Additionally, the refrigerant gas supply system 5 maintains the intake mode even in the state of the bottom dead center, and the spool valve 9 maintains a state where the upper circulation hole 42 and the intake port $P_H$ communicate with each other.

Figure 6E:
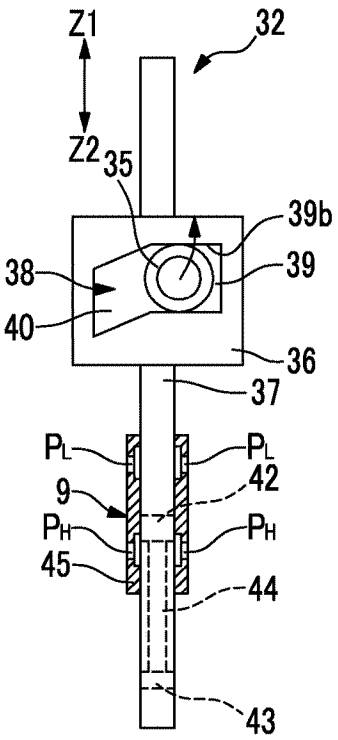
FIGS. 6E to 6G are views for describing the operation of the GM refrigerator according to the embodiment of the invention (Process 2).

FIG. 6E shows a state where the crank 34 has rotated to θ5 shown in FIG. 4 by the drive unit 3A, and hence, the displacers 11 and 21 have moved to the displacement amount H2. In this state, the upper circulation hole 42 and the intake port $P_H$ of the spool valve 9 are spaced apart from each other, and the intake side of the compressor 6 and the room-temperature chamber 14 (cylinders 10 and 20) are brought into a cut-off state. In addition, even at this time, the state where the exhaust port $P_L$ is cut off is maintained.

If the crank 34 further rotates from the state shown in FIG. 6E, the roller bearing 35 moves in the X1 direction within the sliding groove 38 along with this operation, and thereby, the scotch yoke 36 continues moving upward (movement in the Z1 direction). Then, the roller bearing 35 moves in the X1 direction within the sliding groove 38 to an end portion of the sliding groove, and then changes the movement direction to the X2 direction again. Even in the movement of the roller bearing 35, the scotch yoke 36 continues moving in the Z1 direction.

Figure 6F:
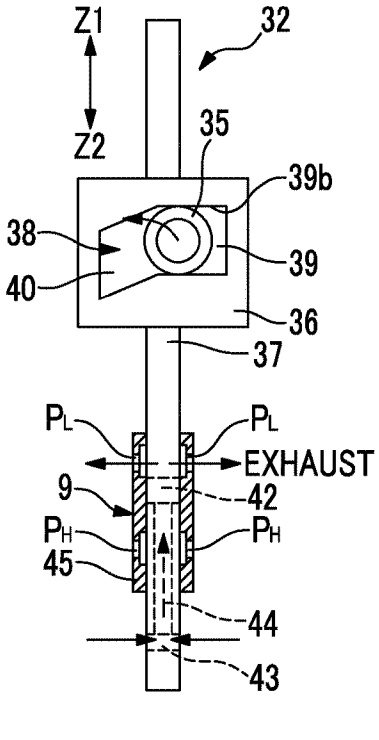

FIG. 6F shows a state where the crank 34 has rotated to θ6 shown in FIG. 4 by the drive unit 3A, and hence, the displacers 11 and 21 have moved to the displacement amount H1 again. In this state, the refrigerant gas supply system 5 performs switching to the exhaust mode again, and hence, the upper circulation hole 42 and the intake port $P_H$ of the spool valve 9 start communication, whereby the suction side of the compressor 6 and the room-temperature chamber 14 (cylinders 10 and 20) are brought into a connected state. Thereby, a low-pressure refrigerant gas starts to flow back to the compressor 6 from the room-temperature chamber 14.

Figure 6G:
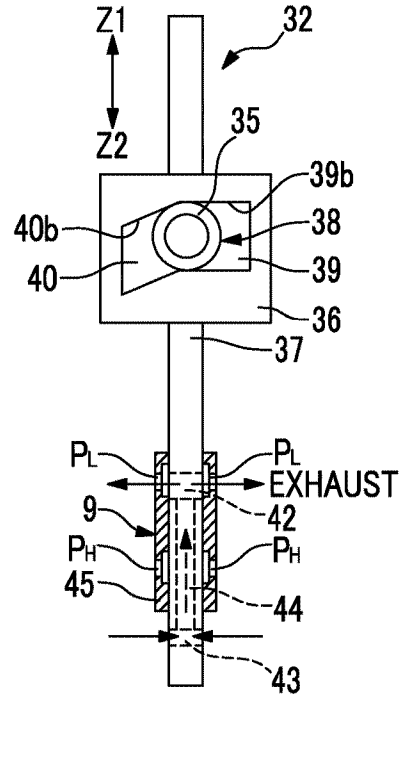

Then, as the roller bearing 35 further rotates to θ7 shown in FIG. 4, as shown in FIG. 6G, the displacers 11 and 21 reach the top dead center (θ7=θ0) again. At this time, the roller bearing 35 is brought into a state where the roller bearing is returned to the middle position (boundary position where the horizontal groove 39 and the inclination groove 40 contact each other) within the sliding groove 38. Additionally, the refrigerant gas supply system 5 maintains the intake mode even in the state of the bottom dead center, and the spool valve 9 maintains a state where the upper circulation hole 42 and the intake port $P_H$ communicate with each other.

By defining the above operation as one cycle and repeating this cycle, the drive unit 3A and the refrigerant gas supply system 5 carry out reciprocal movement of the displacers 11 and 21 and intake and exhaust processing of a refrigerant gas from the compressor 6 to the displacers 11 and 21.

Here, the movement speed (this is equivalent to the movement speed of the scotch yoke 36) of the displacers 11 and 21 is observed.

In the present embodiment, the sliding groove 38 formed in the scotch yoke 36 is constituted by the horizontal groove 39 and the inclination groove 40. The horizontal groove 39 formed on the side of the X1 direction with respect to the central axis CA is a groove in which the horizontal groove lower portion 39*a* and the horizontal groove upper portion 39*b* that constitute the horizontal groove 39 extend in the horizontal direction, similar to the related art. In contrast, the inclination groove 40 formed on the side of the X2 direction with respect to the central axis CA is formed in a shape such that the inclination groove lower portion 40*a* and the inclination groove upper portion 40*b* that constitute the inclination groove extend obliquely downward.

In the drive unit 3A of the present embodiment, the roller bearing 35 moves within the sliding groove 38 that is formed in a shape that is asymmetrical to right and left (in the directions X1 and X2) with respect to the central axis CA in this way. Therefore, the speed of the displacers 11 and 21 (drive rod 37 with a spool) when the displacers move from the bottom dead center to the top dead center during one cycle and the speed of the displacers 11 and 21 (drive rod 37 with a spool) when the displacers move from the top dead center to the bottom dead center are different from each other at the same displacement position.

The operation of the drive unit 3A when the displacers move from the bottom dead center to the top dead center is an operation shown in FIGS. 5D to 6G. That is, this operation is an operation when the roller bearing 35 moves within the horizontal groove 39. The horizontal groove 39 has the same configuration as the sliding groove formed in the scotch yoke of the related art.

Hence, when the displacers move from the bottom dead center to the top dead center (a range of θ4 to θ7), the displacement characteristics (shown by arrow A in the drawing) of the displacers 11 and 21 related to the present embodiment are the same as the displacement characteristics (shown by arrow B in the drawing) of the displacer in the GM refrigerator of the related art. Accordingly, in FIG. 4, when the displacers move from the bottom dead center to the top dead center, the displacement characteristics A of displacers 11 and 21 related to the present embodiment and the displacement characteristics B of the displacer of the related art coincide with each other.

In contrast, the operation of the drive unit 3A when the displacers move from the top dead center to the bottom dead center is an operation shown in FIGS. 5A to 5D. That is, this operation is an operation when the roller bearing 35 moves within the inclination groove 40. The inclination groove 40 is configured so as to extend in a direction inclined by an angle $\theta_G$ in FIG. 3A with respect to the horizontal direction, unlike the sliding groove that is formed in the scotch yoke of the related art and extends in the horizontal direction.

Hence, when the displacers move from the top dead center to the bottom dead center (a range of θ0 to θ4), the displacement characteristics A of the displacers 11 and 21 related to the present embodiment are different from the displacement characteristics B of the displacer in the GM refrigerator of the related art.

If attention is now paid to characteristics near the bottom dead center, at the same displacement position, the magnitude of a movement speed when the displacers 11 and 21 (drive rod 37 with a spool) move to the bottom dead center is larger compared to the magnitude of a movement speed when the displacers 11 and 21 (drive rod 37 with a spool) move away from the bottom dead center.

Specifically, if a displacement position shown by H4 in FIG. 4 is exemplified as the same displacement position, the magnitude of a movement speed V1 when the displacers 11 and 21 (drive rod 37 with a spool) moves to the bottom dead center at the displacement position H4 is larger compared to the magnitude of a movement speed V2 at the displacement position H4 when the displacers 11 and 21 (drive rod 37 with a spool) move away from the bottom dead center ($|V1|>|V2|$).

In contrast, if attention is now paid to characteristics near the top dead center, at the same displacement position, the magnitude of a movement speed when the displacers 11 and 21 (drive rod 37 with a spool) move to the top dead center is larger compared to the magnitude of a movement speed when the displacers 11 and 21 (drive rod 37 with a spool) move away from the top dead center.

Specifically, if a displacement position shown by H3 in FIG. 4 is exemplified as the same displacement position, the magnitude of a movement speed V3 when the displacers 11 and 21 (drive rod 37 with a spool) moves to the top dead center at a displacement position H3 is larger ($|V3|>|V4|$) compared to the magnitude of a movement speed V4 at the displacement position H3 when the displacers 11 and 21 (drive rod 37 with a spool) move away from the top dead center.

In this way, in the drive unit 3A related to the present embodiment, the displacement locus of the displacers 11 and 21 when moving from the top dead center to the bottom dead center is different from the displacement locus of the displacers 11 and 21 when moving from the bottom dead center to the top dead center, and become asymmetrical characteristics.

In addition, in the GM refrigerator of the related art, the magnitude of a movement speed (for example, shown by arrow V1' in FIG. 4) when the displacer moves to the bottom dead center and the magnitude of a movement speed (for example, shown by arrow V2 in FIG. 4) when the displacer moves away from the bottom dead center are equal to each other at the same displacement position, and the magnitude of a movement speed (for example, shown by arrow V3 in FIG. 4) when the displacer moves to the top dead center and the magnitude of a movement speed (for example, shown by arrow V4' in FIG. 4) when the displacer moves away from the top dead center are equal to each other at the same displacement position ($|V1'|=|V2|$, and $|V3|=|V4'|$).

Additionally, at the same displacement position, the movement speed V1' when the displacer of the GM refrigerator of the related art moves to the bottom dead center is smaller compared to the movement speed V1 when the displacers 11 and 21 of the GM refrigerator 1A related to the present embodiment move to the bottom dead center (V1>V1').

Moreover, at the same displacement position, the movement speed V4' when the displacer of the GM refrigerator of the related art moves away from the top dead center is larger compared to the movement speed V4 when the displacers 11 and 21 of the GM refrigerator 1A related to the present embodiment move away from the top dead center (V4<V4').

Next, the working effects obtained by making the displacement locus of the displacers 11 and 21 when moving from the top dead center to the bottom dead center different from the displacement locus of the displacers 11 and 21 when moving from the bottom dead center to the top dead center in the present embodiment as described above will be described.

In the GM refrigerator 1A related to the present embodiment, a high-pressure refrigerant gas is supplied to the respective expansion chambers 15 and 25 in the intake mode (a range of crank angles θ3 to θ5 in FIG. 4), and in the exhaust mode (a range of crank angles θ6 to θ2 in FIG. 4), expansion is performed and exhaust of the refrigerant gas that is made into low pressure is performed.

Here, supposing that the speed V4 when the displacers 11 and 21 moves away from the top dead center is the speed V4' in the related art, the exhaust mode is ended when the displacement amount of the displacers 11 and 21 is H1. In contrast, in the GM refrigerator 1A related to the present embodiment, the speed V4 when the displacers move away from the top dead center is slower than the speed V4' in the related art, the exhaust mode ends at the crank angle θ2 slower than the crank angle θ1.

Accordingly, in the GM refrigerator 1A related to the present embodiment, the exhaust mode can be prolonged by an angle shown by arrow Δθ in FIG. 4 compared to the configuration of the related art in which the displacement locus is symmetrical, by making the displacement locus of the displacers 11 and 21 when moving from the top dead center to the bottom dead center and the displacement locus of the displacers 11 and 21 when moving from the bottom dead center to the top dead center different from each other.

In this way, according to the present embodiment, the heat-exchange time between the refrigerant gas in which cooling is generated, and the cooling stages 18 and 28 and the regenerative materials 13 and 23 can be made longer than that in the related art. Accordingly, the heat exchange efficiency between the refrigerant gas and the cooling stages 18 and 28 and the regenerative materials 13 and 23 is improved, and hence, the cooling efficiency of the GM refrigerator 1A can be enhanced.

On the other hand, in the present embodiment, at the same displacement position, the speed V1 when the displacers 11 and 21 approach the bottom dead center is faster compared to the speed V1' when the displacer in the GM refrigerator of the related art approaches the bottom dead center (V1>V1').

In the intake mode where the high-pressure refrigerant gas is supplied in this way, the displacers 11 and 21 reach the bottom dead center in a short time from the compressor 6. For this reason, it is possible to delay the intake period of the refrigerant gas before the bottom dead center, and the refrigerant gas expanded in the expansion stroke can be completely returned. Therefore, the cooling efficiency of the cryogenic refrigerator can be enhanced.

Additionally, the GM refrigerator 1A related to the present embodiment is configured so as to perform driving of the displacers 11 and 21 by the drive rod 37 with a spool and also perform driving of the spool valve 9 that controls the timing of intake/exhaust from/to the cylinders 10 and 20, as mentioned above. Hence, compared to a configuration in which the driving of valves that perform the driving and intake/exhaust of the displacers are performed by separate drive units, respectively, it is possible to simplify and compactify the configuration of the GM refrigerator 1A and reduce product costs.

Moreover, since the present embodiment has a configuration using not a rotary valve but the spool valve 9, the valve degrades (wears) little over time. For this reason, it is possible to improve the reliability of the GM refrigerator 1A.

Incidentally, in the drive unit 3A used in the above-described embodiment, the scotch yoke mechanism 32 is used to linearly reciprocate the displacers 11 and 21 and drive the spool valve 9. However, it is possible to reciprocate the displacers 11 and 21 and drive the spool valve 9 by other drive units.

Figure 7:
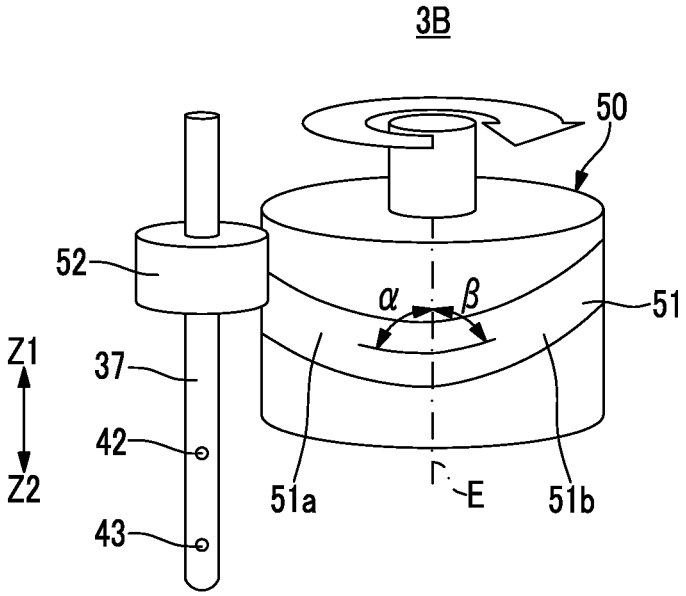
FIG. 7 is a perspective view showing a first modification example of a drive unit.
Figure 8:
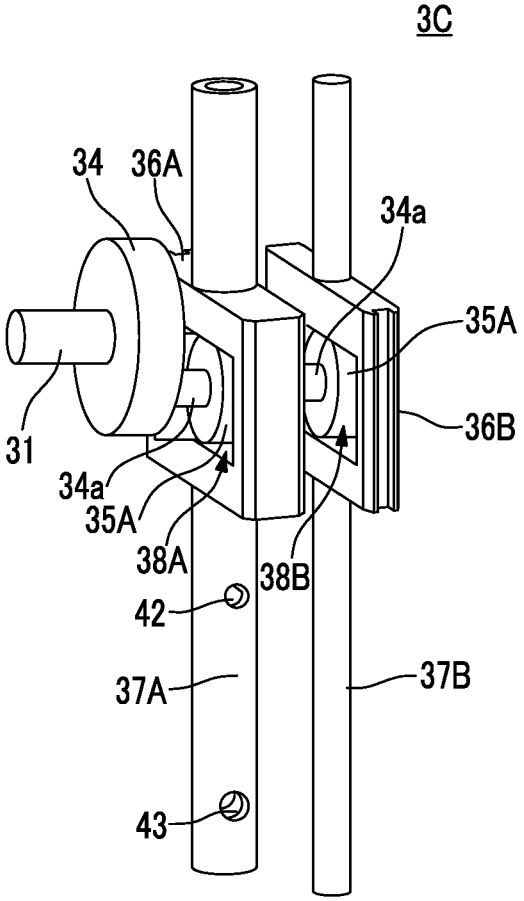
FIG. 8 is a perspective view showing a second modification example of the drive unit.
Figure 9:
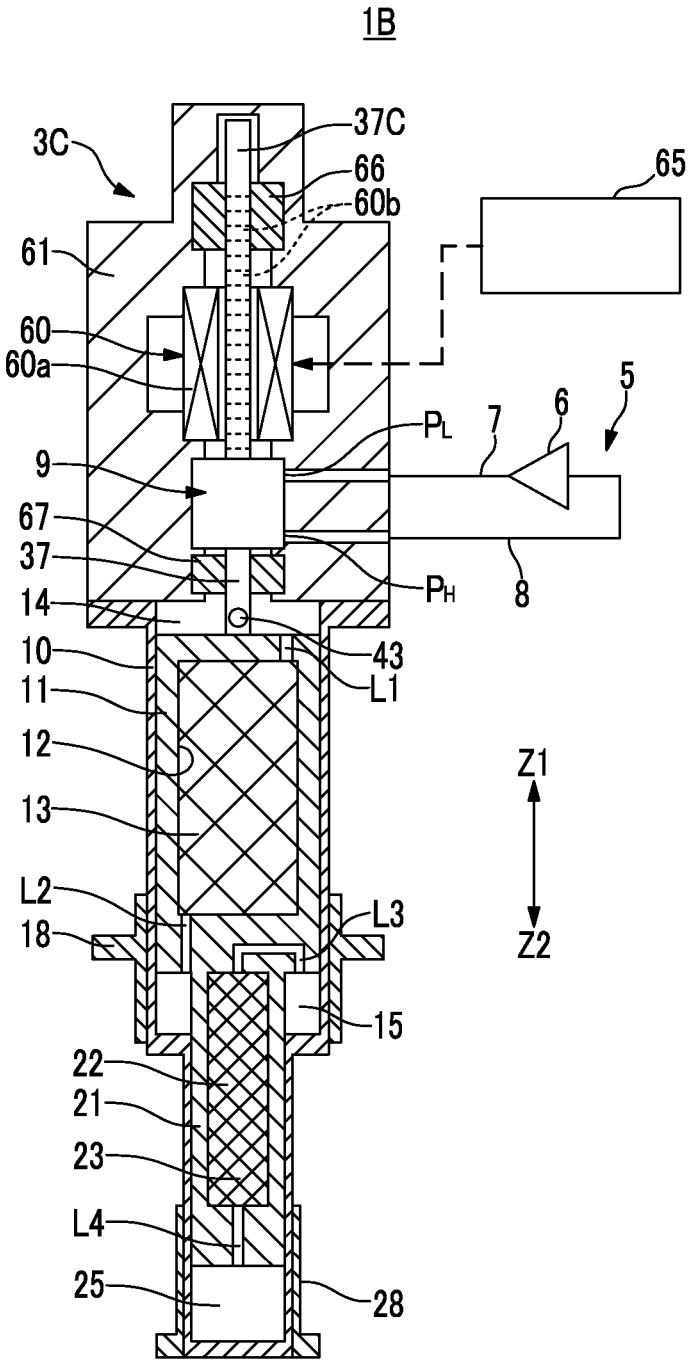
FIG. 9 is a cross-sectional view of a GM refrigerator to which a third modification example of the drive unit is applied.

FIGS. 7 to 9 show first to third modification examples of the above-described drive unit 3A. In addition, in FIGS. 7 to 9, constituents corresponding to the constituents shown in FIGS. 1 to 6 are designated by the same reference numerals, and description thereof is omitted.

FIG. 7 shows a drive unit 3B that is a first modification example. In addition, in FIG. 7, illustration of the GM refrigerator 1A and the spool body 45 is omitted except for the drive unit 3B for convenience of illustration.

The drive unit 3B shown in FIG. 7 uses a cam mechanism including a cylindrical cam 50 and a driven roller 52 as a drive mechanism that drives the drive rod 37 with a spool.

The cylindrical cam 50 is configured so as to rotate at constant speed by a motor or the like, and an outer periphery thereof is formed with a cam groove 51 approximated to a sinusoidal waveform. The driven roller 52 engages the cam groove 51, and hence, the driven roller 52 performs movement in the directions of arrows Z1 and the Z2 in the drawing in correspondence with the shape of the cam groove 51. Additionally, the driven roller 52 is attached to the drive rod 37 with a spool, and hence, as the drive rod 37 with a spool moves upward and downward (moves in the Z1 and the Z2 directions), the displacers 11 and 21 that are not shown also move upward and downward.

In the present embodiment, the cam groove 51 is configured so that the drive rod 37 with a spool performs one upward and downward movement, as the cylindrical cam 50 makes a rotation of 180°. Hence, as the cylindrical cam 50 makes one rotation, the drive rod 37 with a spool performs two upward and downward movements, and along with this, the displacers 11 and 21 are also configured so as to perform two reciprocal displacements (configured so as to perform a two-cycle operation).

Here, if attention is paid to the shape of the cam groove 51, assuming a line segment (one-dot chain line shown by arrow E in FIG. 7) parallel to a rotational axis is located at a position corresponding to the bottom dead center of the cam groove 51, the inclination (shown by arrow α in FIG. 7) of a cam groove portion 51*a*, which extends in a rotational direction from the line segment E, with respect to the line segment E is set to be larger than the inclination of a cam groove portion 51*b*, which extends in a direction opposite to the rotational direction from the line segment E, with respect to the line segment E (shown by arrow β in FIG. 7).

By adopting this configuration, similar to the drive mechanism 3A described with reference to FIGS. 1 to 6, at the same displacement position in the vicinity of the bottom dead center, the magnitude of a movement speed when the displacers 11 and 21 (drive rod 37 with a spool) move to the bottom dead center becomes larger compared to the magnitude of a movement speed when the displacers 11 and 21 (drive rod 37 with a spool) move away from the bottom dead center.

Additionally, at the same displacement position in the vicinity of the top dead center, the magnitude of a movement speed when the displacers 11 and 21 (driving rod 37 with a spool) move to the top dead center is larger compared to the magnitude of a movement speed when the displacers 11 and 21 (driving rod 37 with a spool) moves away from the top dead center. Hence, even in a case where the drive unit 3B is applied to the GM refrigerator, similar to a case where the drive mechanism 3A is used, the cooling efficiency of the GM refrigerator can be improved, the GM refrigerator can be made compact, or the like.

In addition, although a configuration in which the drive rod 37 (displacers 11 and 21) with a spool twice performs reciprocal operations as the cylindrical cam 50 makes one rotation is shown in the above-described first modification example, the invention is not limited to this. For example, the configuration of the cylindrical cam may be a configuration (configuration in which one cycle of operation is performed) in which the drive rod with a spool (displacer) performs one reciprocal operation by one rotation.

FIG. 8 shows a drive unit 3C that is a second modification example.

The present modification example is configured so that a spool 37A that opens and closes the spool valve 9 and a drive rod 37B that drives the displacers 11 and 21 are separately provided.

The spool 37A is provided with the upper circulation hole 42, the lower circulation hole 43, the communication channel 44, a scotch yoke 36A for a spool, and the like. Additionally, the drive rod 37B is provided with a scotch yoke 36B for displacers.

The pin 34*a* of the crank 34 is provided with a roller bearing 35A for a spool and a roller bearing 35B for displacers. The roller bearing 35A for a spool engages a sliding groove 38A for a spool of the scotch yoke 36A for a spool, and the roller bearing 35B for displacers is configured so as to engage the sliding groove 38B for displacers.

In the drive unit 3C related to the present modification example, the scotch yoke 36A for a spool provided in the spool 37A and the scotch yoke 36B for displacers provided in the drive rod 37B are separately configured. For this reason, the shape of the sliding groove 38A for a spool and the shape of the sliding groove 38B for displacers can be made different from each other. Hence, according to the drive unit 3C related to the present modification example, the degree of freedom in the combination between the driving timing of the spool valve 9 and the driving timing of displacers 11 and 21 can be enhanced.

FIG. 9 shows a GM refrigerator 1B using the drive unit 3C that is a third modification example.

The present modification example uses a linear motor 60 as the drive unit 3C. The linear motor 60 is constituted by an electromagnet 60*a* and a permanent magnet 60*b* provided integrally with a drive rod 37C with a spool.

A motor housing 61 is provided above the first-stage displacer 11. The electromagnet 60*a* that constitutes the linear motor 60 is fixed to the motor housing 61. The permanent magnet 60*b* has a configuration in which a plurality of small magnets is alternately arranged so that magnetization directions are different from each other.

The electromagnet 60*a* is formed in a cylindrical shape, and has the drive rod 37C with a spool inserted therethrough. Thereby, the permanent magnet 60*b* of the drive rod 37C with a spool is configured so as to face the electromagnet 60*a*. Hence, the drive rod 37 with a spool can be driven in the upward and downward directions (Z1 and Z2 directions) by supplying an electric current to the electromagnet 60*a*, and the movement speed can be made variable by controlling the amount of an electric current.

The electromagnet 60*a* is connected to a control device 65. Additionally, a drive program that drives the drive rod 37 is stored in the control device 65.

As the control device 65 executes the drive program, the control device controls the speed of the drive rod 37C with a spool so that, at the same displacement position in the vicinity of the bottom dead center, the magnitude of a movement speed when the displacers 11 and 21 (driving rod 37 with a spool) move to the bottom dead center is larger compared to the magnitude of a movement speed when the displacers 11 and 21 (driving rod 37 with a spool) moves away from the bottom dead center.

Additionally, as the control device 65 executes the drive program, the control device controls the speed of the drive rod 37C with a spool so that, at the same displacement position in the vicinity of the top dead center, the magnitude of a movement speed when the displacers 11 and 21 (driving rod 37 with a spool) move to the top dead center is larger compared to the magnitude of a movement speed when the displacers 11 and 21 (driving rod 37 with a spool) moves away from the top dead center.

Hence, even in a case where the drive unit 3C related to the present modification example is applied to the GM refrigerator, similar to cases where the drive mechanisms 3A and 3B are used, the cooling efficiency of the GM refrigerator can be improved, the GM refrigerator can be made compact, or the like.

Although the preferable embodiments of the invention have been described above in detail, the invention is not limited to the above-described specific embodiments, and various alterations and changes can be made within the scope of the invention described in the claims.

For example, although an example in which the drive shaft of the spool valve is arranged in the vertical direction has been described in the above embodiments, the arrangement direction is not limited to this. In a case where the drive shaft of the spool valve is arranged in a non-vertical direction, the top dead center in the embodiments indicates the movement limit position of one spool, and the bottom dead center indicates the movement limit position of the other spool.

What is claimed is:

1. A cryogenic refrigerator comprising:

a cylinder;

a displacer that is mounted within the cylinder;

a spool valve that is connected to a compressor and performs switching between an intake mode where a high-pressure refrigerant gas is supplied from the compressor to the cylinder and an exhaust mode where a low-pressure refrigerant gas within the cylinder is made to flow back to the compressor; and a drive unit configured to move the spool valve, the drive unit including a scotch yoke frame comprising a sliding groove formed therein and a crank pin configured to engage with the sliding groove through a roller bearing, wherein the sliding groove includes a horizontal groove and an inclination groove which are connected to each other at a predetermined position, the inclination groove extends obliquely downward from the predetermined position, wherein the horizontal groove extends in a direction orthogonal to an axial direction, the predetermined position is a center of the sliding groove in the direction orthogonal to the axial direction, wherein the spool valve has a valve body and a drive rod that extends in the axial direction, the drive rod moves relative to the valve body, wherein the drive unit is configured to move the spool valve in a manner such that a speed of the drive rod when the drive rod moves from a top dead center to a bottom dead center is different from a speed of the drive rod when the drive rod moves from the bottom dead center to the top dead center, at a same displacement position, and wherein the displacer is connected to a lower end portion of the drive rod and the scotch yoke frame is connected to an upper end portion of the drive rod.

2. The cryogenic refrigerator according to claim 1, wherein the drive unit drives the displacer so that, at the same displacement position in the vicinity of the bottom dead center, the magnitude of a speed when the drive rod moves to the bottom dead center is larger compared to the magnitude of a speed when the drive rod moves away from the bottom dead center.

3. The cryogenic refrigerator according to claim 1, wherein the drive unit drives the displacer so that, at the same displacement position in the vicinity of the top dead center, the magnitude of a speed when the drive rod moves to the top dead center is larger compared to the magnitude of a speed when the drive rod moves away from the top dead center.

4. The cryogenic refrigerator according to claim 1, wherein the drive rod includes an upper circulation hole that is formed so as to pass through the drive rod in a direction orthogonal to the axial direction of the drive rod, a lower circulation hole that is arranged so as to be spaced apart from the upper circulation hole in the axial direction and is formed so as to pass through the drive rod in a radial direction orthogonal to the axial direction, and a communication channel that is formed within the drive rod and communicates the upper circulation hole with the lower circulation hole, wherein the lower circulation hole opens to a room-temperature chamber formed between the cylinder and the displacer.

5. The cryogenic refrigerator according to claim 1, wherein the horizontal groove is formed by flat upper and lower surfaces, and the inclination groove is formed by flat upper and lower surfaces.

* * * * *